US005421670A

United States Patent [19]

Meirick

[11] Patent Number: 5,421,670

[45] Date of Patent: Jun. 6, 1995

[54] ROLLER FOR IMPRESSING PATTERNS IN A MALLEABLE SURFACE HAVING A REPLACEABLE SHELL THEREON

[76] Inventor: Herbert J. Meirick, Rte. 3 228E, Mount Vernon, Mo. 65712

[21] Appl. No.: 239,754

[22] Filed: May 9, 1994

[51] Int. Cl.[6] ..... E01C 19/26

[52] U.S. Cl. ..... 404/124; 425/385

[58] Field of Search ..... 404/89, 93, 97, 124; 425/385, 456

[56] References Cited

U.S. PATENT DOCUMENTS

| | | | |
|---|---|---|---|
| 324,166 | 8/1885 | Riordan . | |
| 397,731 | 2/1889 | Laird et al. . | |
| 519,919 | 5/1894 | Maurer . | |
| 967,714 | 8/1910 | Blome et al. . | |
| 993,086 | 5/1911 | Malloy . | |
| 1,063,752 | 6/1913 | Walling . | |
| 1,099,185 | 6/1914 | Loveland . | |
| 3,406,618 | 10/1968 | Bowman . | |
| 3,832,079 | 8/1974 | Moorhead | 404/72 |
| 3,910,738 | 10/1975 | Chandler et al. | 425/162 |
| 4,105,354 | 8/1978 | Bowman | 404/72 |
| 4,237,984 | 12/1980 | Cobb et al. | 172/554 |
| 4,766,771 | 8/1988 | Bailey et al. | 74/61 |
| 5,033,906 | 7/1991 | Jordan | 404/120 |
| 5,228,799 | 7/1993 | Sondreal | 404/124 |

*Primary Examiner*—William P. Neuder

*Attorney, Agent, or Firm*—Kokjer, Kircher, Bowman & Johnson

[57] ABSTRACT

A roller assembly is provided for imprinting a pattern in a malleable surface wherein a hub is formed with a cylindrical frame receives a pattern forming shell thereon. The shell is formed of a thin cylindrical tube having a smooth interior surface and a raised ridged pattern on its exterior surface corresponding to the desired pattern. The shell includes a separation crack or seam extending longitudinally along its perimeter parallel to the rotational axis of the shell, to allow the shell to expand and receive the cylindrical hub therein. Within the cylindrical shell and along opposite sides of the crack or seam, is formed a support which includes latches to close the crack. When locked, these latches cause the diameter of the shell to contract and fit snugly against the cylindrical frame of the hub. The roller further includes a shaft positioned in front of and extending across a face of the roller. This shaft supports a roll of ultra-thin plastic which is unrolled simultaneously with the roller. This sheet of plastic is formed with sufficient elasticity and sufficiently thin to allow the roller to easily press the plastic into wet concrete. The ultra-thin plastic is extremely elastic in order that it may stretch around the contact points between the ridges formed on the rolling shell, thereby providing rounded edges along each groove formed in the concrete.

22 Claims, 2 Drawing Sheets

ROLLER FOR IMPRESSING PATTERNS IN A MALLEABLE SURFACE HAVING A REPLACEABLE SHELL THEREON

BACKGROUND OF THE INVENTION

1. Field of the Invention

The present invention is generally related to a roller for impressing a desired pattern in a malleable surface, such as concrete and the like.

2. Description of the Related Art

In the past, a system has been proposed (U.S. Pat. No. 5,033,906) for imprinting a pattern on concrete through the use of a roller having a plurality of spaced running ridges and spaced header ridges defined thereon. The running and header ridges define an impression pattern on the roller surface for impressing a corresponding simulated masonry pattern on the concrete. The ridges are configured such that multiple patterns may be rolled adjacent to one another by providing one end of the roller with an end ridge and an opposite end of the roller without an end ridge. The header and running ridges are formed integrally upon a roller core which is filled with a liquid material to add weight to the roller. Additionally, the roller of the '906 patent uses a vibrator to induce vibrations throughout the apparatus in order to enhance the impression-making ability thereof.

An alternative system has been proposed (U.S. Pat. No. 4,105,354) in which a pattern forming wheel is used with uncured concrete surfaces. The wheel includes a generally cylindrical frame which is large enough to accommodate a worker in a walking position. The frame supports a plurality of rigid blades carried about its outside surface, wherein the blades are configured to provide a desired pattern. A walkway is provided on the inside surface of the frame to support the worker. The frame may be gripped by the worker and serve as a hand-hold if desired. The weight of the worker is combined with the weight of the wheel to aid in driving the blades into the surface of the slab to a predetermined depth. A plurality of tools of the same diameter may be peripherally linked together to increase simultaneous pattern imprinting width so that the combination of linked tools will span the width of large slabs.

An alternative system has been proposed (U.S. Pat. No. 3,832,079) in which an apparatus is driven over partially cured concrete to form a pattern therein. The system of the '079 patent includes a plastic film or other suitable release agent which permits the apparatus to be driven on the concrete to form the pattern without removing the surface of the concrete when it is withdrawn. The '079 patent generally comprises a roller with a series of patterns constructed from blades that conform to the pattern to be pressed into the concrete. As a substitute for the plastic sheet, the '079 patent sprays releasing agents, such as silicones and tetrafluoralethylenes, on the roller blades or on the concrete to prevent binding and gouging of the pavement.

However, these prior art systems have met with limited success. The system of the '906 patent only offers a single pattern integrally within the concrete impressing system. Hence, if it is desirable to use a different pattern, an entirely separate roller must be formed. Similarly, in the system of the '354 patent, separate wheels must be formed for each desired pattern. In the system of the '079 patent, the entire roller assembly pulled by the tractor must be replaced to change the pattern impressed into the concrete. The necessity of separate impressing systems for each pattern render it unduly expensive to use multiple patterns.

Further, each of the '534, '079, and '906 patents require that the concrete partially cure before the pattern is formed therein. This is due in part to the fact that heretofore, plastics have been used between the roller and concrete which were undesirably thick. These overly thick plastics resist the downward forces exerted by the pattern forming ridges of the roller upon the concrete. Thus, overly thick plastics inhibit pattern formation. To compensate for this plastic inhibiting effect, the prior art rollers add additional weight to the roller to force the pattern forming ridges and the plastic into the concrete.

Further, the thick plastics used by the prior art rollers prevent the formation of properly formed edges along each indentation within the concrete. When the plastic is forced into the grooves in the concrete, the plastic applied excessive force along the edges of each groove. The excessive force applied by these somewhat rigid plastics degraded the pattern by deforming the upper edges of each brick within the concrete. To properly form these edges, the prior art systems require the concrete to be partially cured before using the roller. This partially cured concrete, once impressed, is able to withstand the forces of the plastic upon the corners. However, when impressing a pattern into partially concrete further increases the need for additional weight within the roller and the need for a waiting period between the time that the concrete is poured and the time that the roller is used.

Further, the system of the '079 patent removes the sheet of plastic from the concrete immediately after the pattern is pressed therethrough. Consequently, the system of the '079 patent is unable to provide a slick finish upon the concrete. The texture of the concrete is determined by the curing time period during which the plastic is left on the concrete. Thus, if a rough textured concrete is desired, the plastic may be peeled off immediately. However, if a slick surface is desired upon the concrete, the plastic must remain for a significant portion of the curing time, such as overnight. The slicker the finish upon the concrete, the better it resists penetration by water. Also, the initial curing time required by the prior art systems before impressing the pattern limits the system's ability to provide a slick surface.

Moreover, once a concrete slab has been laid, it is often desirable to paint or stain the concrete to a color other than the concrete's natural color. To effect such changes in color, a variety of systems have been proposed. For instance, the concrete may be painted with ordinary stain, or enamel-based or latex-based paint once it cures sufficiently. However, in the past these stains and paints have quickly and easily chipped off of the concrete. Further, it has been unduly difficult to lay down a smooth and even layer of stain or paint.

Alternatively, it has been proposed to add pigmentations, stains or paints to the concrete prior to pouring it. However, the desired color additive must be introduced before or while the concrete is within the mixer which causes the interior of the mixing tank to become similarly colored. The pigmentations, paints, and stains added to the concrete while in the mixer further interfere with the long term operation of the mixing and pouring equipment.

The need remains in the industry for an improved pattern forming roller and method for painting such concrete. It is the object of the present invention to meet these needs, and to overcome drawbacks previously experienced.

SUMMARY OF THE INVENTION

It is an object of the present invention to provide a roller for pressing patterns into malleable surfaces, wherein multiple shells having different patterns may be interchangeably secured to a single roller frame.

It is another object of the present invention to provide a roller for impressing patterns in malleable surfaces which reduces the overall weight of the roller assembly.

It is another object of the present invention to provide a roller assembly which utilizes an extremely thin film of plastic to enable the rolling assembly's implementation with wet concrete immediately after the concrete has been poured.

It is another object of the present invention to provide a roller assembly which simultaneously lays down an extremely thin film of plastic as the roller impresses the pattern.

It is another object of the present invention to provide a roller assembly having a vibrator therein which is variable dependent upon the cured state of the concrete.

It is another object of the present invention to provide a method for producing a stain or paint which adheres strongly to concrete.

It is another object of the present invention to provide a method of staining or painting in which the paint or stain is easily spread upon concrete and exhibits strong adhesive qualities with respect to the concrete.

Other and further objects of the invention, together with the features of novelty pertinent thereto, will appear in the detailed description set forth below.

In summary, a roller assembly is provided for imprinting a pattern in a malleable surface wherein a hub is formed with a cylindrical frame to receive a pattern forming shell thereon. The shell is formed of a thin cylindrical tube having a smooth interior surface and a raised ridged pattern on its exterior surface corresponding to the desired pattern. The shell includes a separation crack or seam extending longitudinally along its perimeter parallel to the rotational axis of the shell, to allow the shell to expand and receive the cylindrical hub therein. Within the cylindrical shell and along opposite sides of the crack or seam, is formed a support which includes latches to close the crack. When locked, these latches cause the diameter of the shell to contract and fit snugly against the cylindrical frame of the hub. The roller further includes a shaft positioned in front of and extending across a face of the roller. This shaft supports a roll of ultra-thin plastic which is unrolled simultaneously with the roller. This sheet of plastic is formed with sufficient elasticity and sufficiently thin to allow the roller to easily press the plastic into wet concrete. The ultra-thin plastic is extremely elastic in order that it may stretch around the contact points between the ridges formed on the rolling shell, thereby providing rounded edges along each groove formed in the concrete.

In addition, a method is provided for producing and applying a concrete stain or paint having desirable characteristics to allow the stain or paint to be spread easily and to be adhered securely to a concrete surface. The paint or stain comprises any desired type of paint or stain for outdoor use, an adhesive (such as glue and water). The paint or stain, water and glue are spread over a concrete surface once the concrete has chemically cured to a desired state. Once the concrete completely cures and the paint or stain and glue dry, the combination provides a strong adhesive bond therebetween.

BRIEF DESCRIPTION OF THE DRAWINGS

The objects and features of the invention noted above are explained in more detail with reference to the drawings, in which like reference numerals denote like elements, and in which.

DETAILED DESCRIPTION OF THE INVENTION

Figure 1:
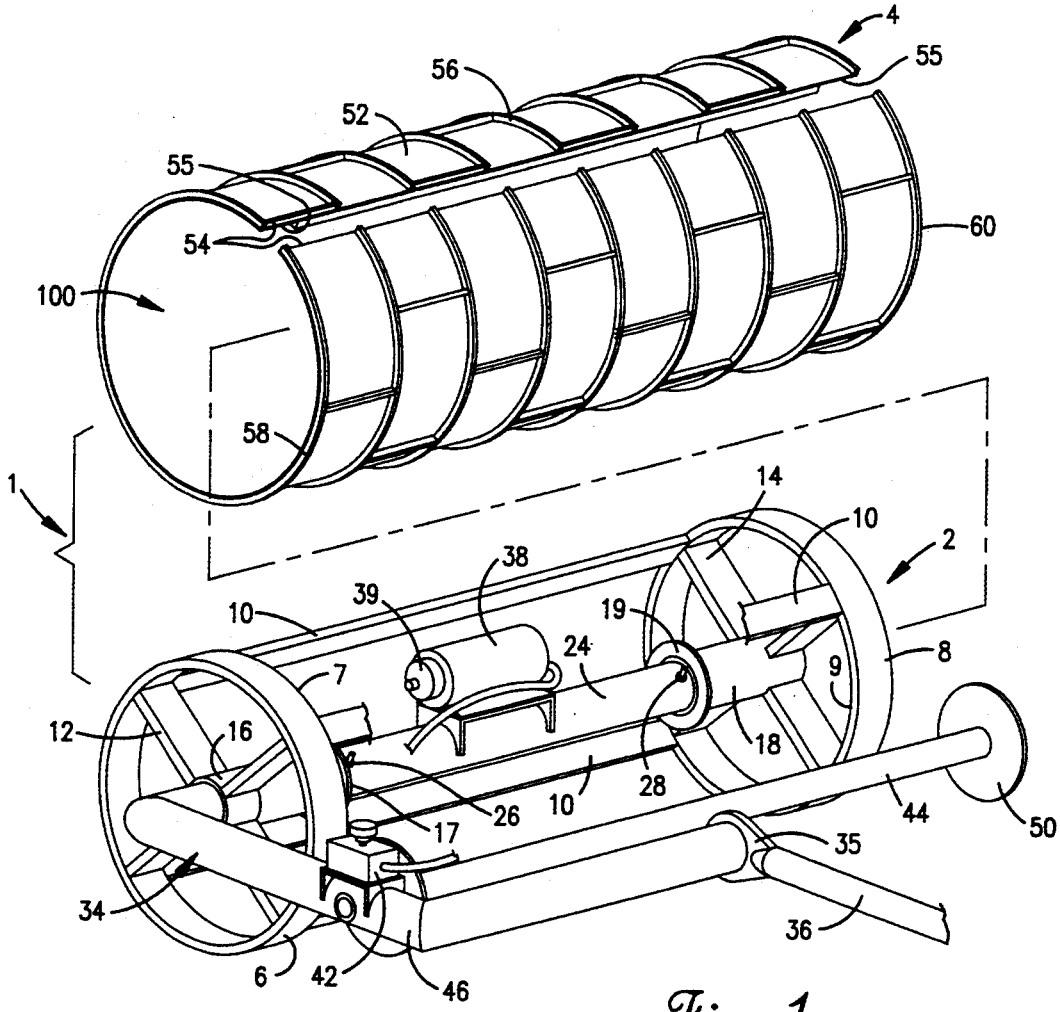
FIG. 1 denotes a side elevational exploded view of the present invention.

FIG. 1 illustrates a roller in accordance with the present invention in an exploded position, which is generally designated by the reference numeral 1. The roller 1 includes a hub 2 constructed from a cylindrically shaped frame. The hub 2 is received within a cylindrically shaped pattern forming shell 4. The hub 2 includes circular inner and outer bands 6 and 8. The bands 6 and 8 are interconnected through flat support straps 10 which extend parallel to the rotational axis of the hub 2. The straps 10 are secured to inside surfaces 7 and 9 of the inner and outer bands 6 and 8, such that outer surfaces of the support straps 10 and the inner and outer bands 6 and 8 are substantially flush with one another. The inner and outer bands 6 and 8 are oriented at distal-proximate ends of the hub 2 from one another and aligned to rotate about a common rotational axis. The inner and outer bands 6 and 8 include spokes 12 and 14, respectively, which extend radially inward from corresponding bands. The spokes 12 and 14 include inner ends which are secured to inner and outer rotational collars 16 and 18. The inner and outer collars 16 and 18 are tubular in shape and oriented such that their longitudinal axes align with the rotational axis of the hub. The inner and outer collars 16 and 18 project inward between the inner and outer bands 6 and 8. The inner and outer collars 16 and 18 rotationally receive an axle 24 which extends along the rotational axis of the hub 2. The axle 24 includes inner and outer hub retainers 26 and 28 secured thereto proximate and in abutting relation with the inner and outer flanges 17 and 19 between the collars 16 and 18 to maintain the hub 2 in a desired position relative to the axle 24. By way of example only, the retainers 26 and 28 may represent bolts which are inserted through holes within the axle 24. The holes within the axle 24 are positioned proximate the innermost flanges 17 and 19 of the inner and outer collars 16 and 18, respectively. Washers may be received upon the axle 24 and abut against the hub retainers 26 and 28, and against the collars 16 and 18 to maintain the hub 2 in a desired position relative to the axle 24.

The axle 24 extends beyond the inner collar 16 and is formed integrally with one end of a U-shaped elbow 34. An opposite end 35 of the U-shaped elbow 34 is constructed to receive releasably a handle 36 which is used to pull the roller 1 across a malleable surface. The U-shaped elbow 34 is constructed to orient the handle 34 in a direction perpendicular to the rotational axis of the roller 1 and to position the handle 36 at a point interposed centrally between the inner and outer bands 6 and 8. By orienting the handle in this manner, a user is able to pull the roller along a straight line even though the handle 36 is secured to one end of the roller 1.

Mounted upon the axle 24 is a motor 38 having an unbalanced load 39 secured to the rotational shaft thereof, which causes the roller to vibrate during operation to enhance the roller's pattern impressing ability. The motor 38 is securely fastened to the axle 24, such as through U-clamps. The vibrating motor 38 is located along the axle 24 at a point slightly closer to the outer band 8, as compared to the inner band 6. This slight off-center alignment compensates for the additional weight experienced by the inner band 6 due to the U-shaped elbow 34. The vibrating motor 38 is connected to a variable speed switch 42 which operates to control the vibrating force of the motor 38. The vibrating force is varied depending upon the consistency of the material to be impressed, such as wet concrete or somewhat cured concrete. The switch 42 may be located along the U-shaped elbow 34 or, optionally, along the handle 36.

Figure 2:
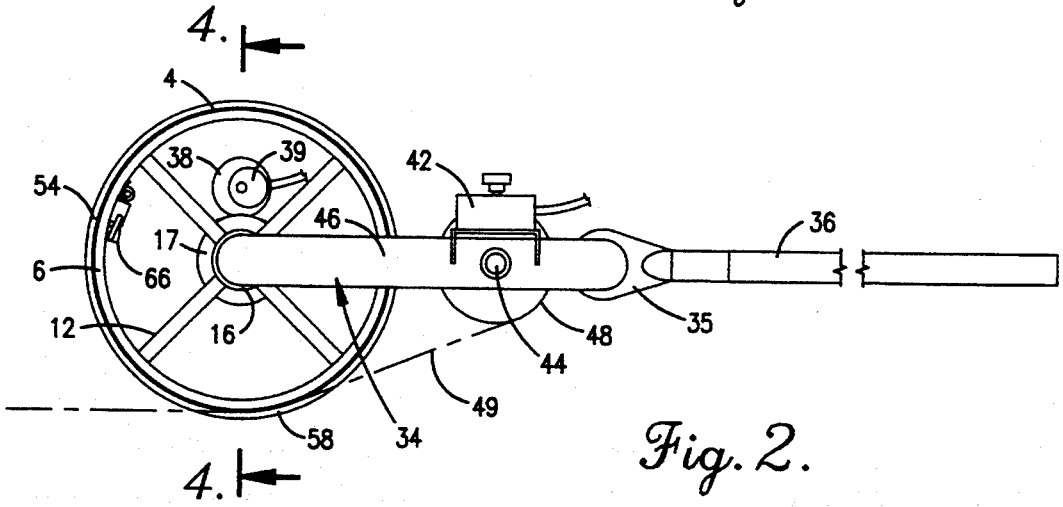
FIG. 2 illustrates a side perspective view of the present invention when in operation.
Figure 3:
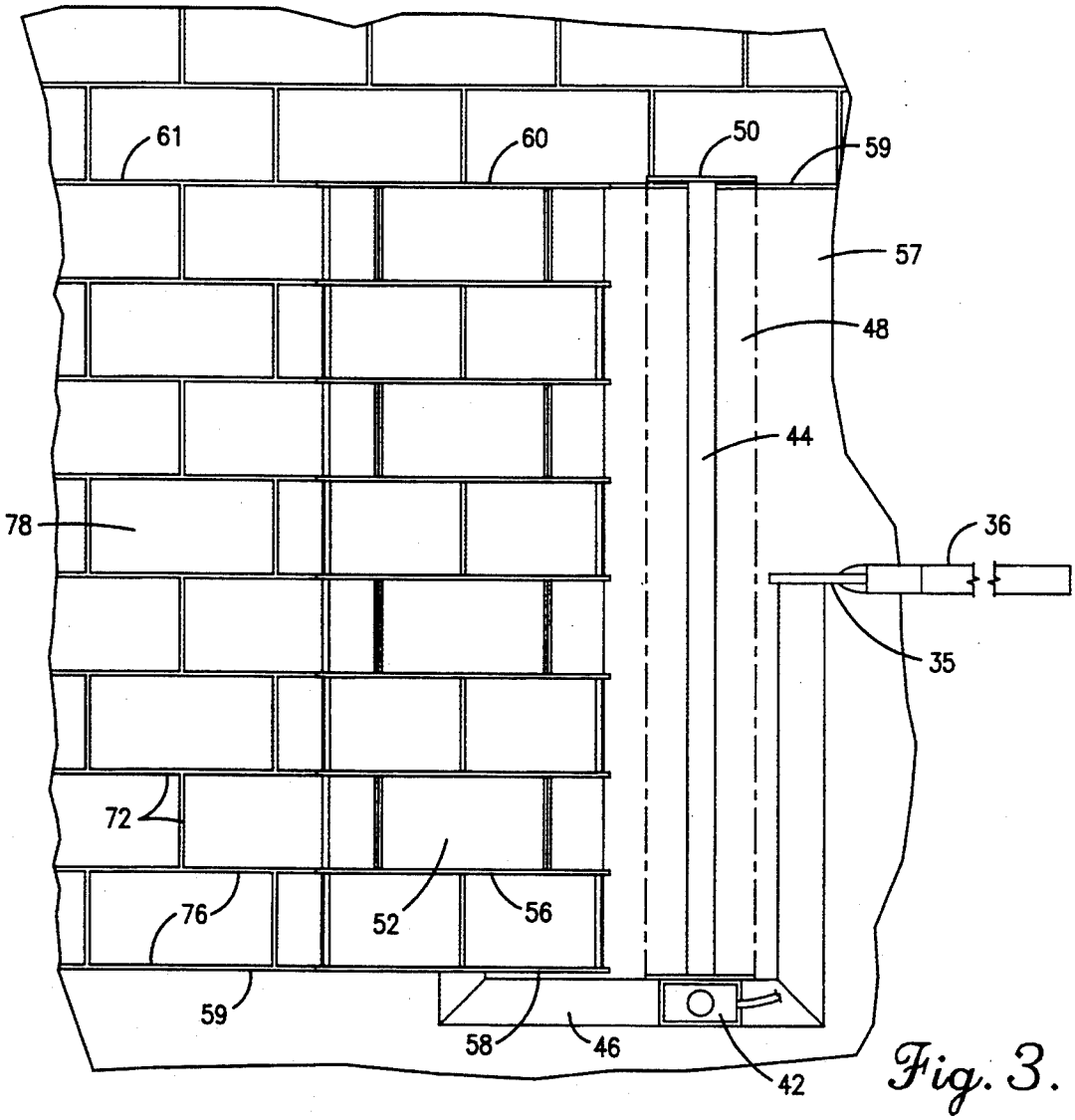
FIG. 3 illustrates a top view of the present invention while forming a patter.

As illustrated in FIGS. 1–3, a film support shaft 44 is secured to a base 46 of the elbow 34. The support shaft 44 rotatably receives a roll of ultra-thin elastic film, such as plastic film. The support shaft 44 projects across a front face of the hub 2 and in a direction parallel to the rotational axis of the hub 2. A removable stopper 50 is received upon the outer end of the support shaft 44 to retain the film roll 48 thereon. The film roll 48 is formed with a width slightly wider than that of the pattern forming shell 4 to ensure that outer ridges upon the shell 4 are entirely isolated from the malleable surface during operation.

FIGS. 1 and 3 illustrate a pattern forming shell 4 which includes a flat tubular core 52 constructed of a semi-rigid material, such as aluminum. The core 52 is formed in a tubular shape with a seam 54 extending along one side thereof. The seam 54 allows the core 52 to expand and contract radially thereby varying its diameter. A plurality of ribs 56 are securely received upon and cover an outer periphery of the core 52. The ribs 56 form a predetermined raised pattern thereon which will be used to form a desired impression in a malleable surface 57 (as illustrated in FIG. 3). The ribs 56 include inner and outer edging ridges 58 and 60 which form outer grooves 59 and 61 along opposite sides of the impression formed in the malleable surface 57. The inner and outer edging ridges 58 and 60 may be formed with the same width. Optionally, the inner and outer ridges 58 and 60 may be formed with slightly different widths such that once the leading edge ridge (i.e. the thicker ridge 58) forms a groove in the impression, the trailing ridge (i.e., the thinner ridge 60) may travel within this groove, during the next pass. By mismatching the edge widths, the invention avoids increasing the trailing groove's width 61 beyond that of the thickest edge ridge if the roller becomes slightly misaligned during the second pass.

Figure 4:
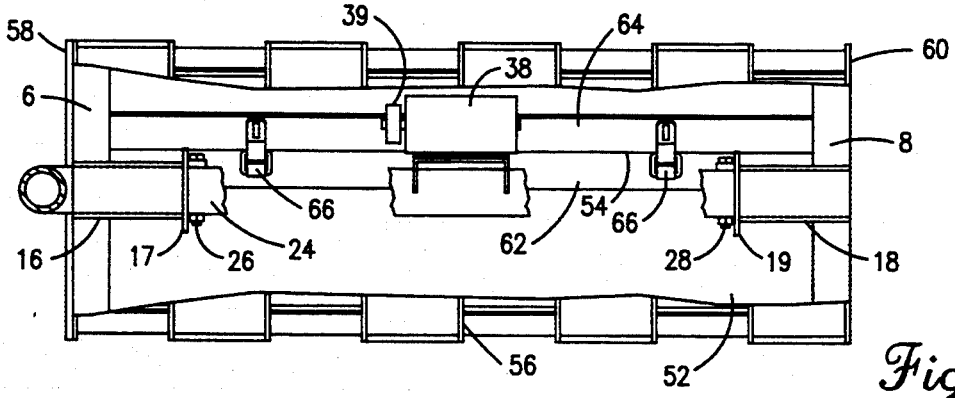
FIG. 4 illustrates a front-sectional view along line 4—4 in FIG. 2.

FIG. 4 illustrates the interior surface of the core 52 of the shell 4. The core 52 includes two rectangular seam support bands 62 and 64 located along opposite sides of the seam 54 are formed with a length slightly shorter than a length of the core 52. While the seam and support bands are illustrated as running along a straight line traversing the concrete, they may be any other shape (e.g., spiral) so long as they extend across the entire width of the core. The upper and lower bands 62 and 64 are centered longitudinally within the core 52 such that a portion (55 in FIG. 1) of the core 52 is exposed proximate the seam 54 at opposite ends of the bands 62 and 64. The bands 62 and 64 have a length substantially equal to that of the support straps 10. The seam support bands 62 and 64 include multiple locking mechanisms 66 thereon which operate to pull the upper and lower seam support bands 62 and 64 together when the seam 54 is closed. When the locking mechanisms 66 pull the upper and lower seam support bands 62 and 64 against one another, this operation also closes the seam 54. As the seam 54 is closed, the inner diameter of the core 52 is reduced and securely received on the hub 2. In this position, bands 62 and 64 fit between the inner and outer circular bands 6 and 8. The circular bands 6 and 8 abut against the exposed portions 55 of the core 52 and secure retain opposed ends of the upper and lower support bands 62 and 64.

During operation, the pattern forming shell 4 is selected having a desired pattern of ribs 56 thereon and installed on the hub 2. This pattern may be oriented in any direction relative to the rotational axis of the hub 2. To effect installation, the locking mechanisms 66 are released thereby allowing the upper and lower bands 62 and 64 to separate which opens the seam 54 and increases the diameter of the core 52. Separation of the seam 54 is due primarily to the springing effect of the material used to form the core 52. Next, the shell 4 is aligned such that one end 100 thereof is located immediately adjacent the outer band 8 of the hub 2. When the seam 54 is in an expanded condition, the support bands 62 and 64 will clear the outer circular band 8. Next, the shell 4 is slid along the rotational axis of the hub 2 until the entire hub frame 2 is received within the shell 4. During this sliding operation, the seam 54 must be sprung such that the inner diameter of the core 52 is sufficient to allow the locking mechanisms 66 and the band 62 and 64 to pass by the outside of the outer circular band 8. When in an installed position, the inner and outer bands 6 and 8 align with end portions 55 of the core 52 at opposite ends of the shell 4.

Thereafter, the locking mechanisms 66 are closed to draw the upper and lower bands 62 and 64 against one another thereby completely sealing the seam 54. When in a sealed position, the inner diameter of the core contracts such that the inner periphery of the core 52 is snugly and frictionally engaged with the outer surfaces of the inner and outer bands 6 and 8 and the straps 10. This snug fit retains the shell 4 in a fixed relation to the hub 2. The locking mechanisms 66 and the bands 62 and 64 operate to ensure that the edges of the core 52 and ridges 56, 58 and 60 along the seam 54 abut against one another in a substantially flush alignment. It is necessary to provide a flush alignment along the seam 54 and between adjoining ends of each rib 56, 58 and 60 that is split at the seam 54 to ensure that this union does not adversely affect the impression left in the malleable surface.

A film roll 48 is slidingly received upon the support shaft 44 and the handle 36 is threadably inserted into an outer end of the U-shaped elbow 34. Next, the roller 1 is positioned at an outer edge of the surface 57 to be imprinted. The variable speed switch 42 is adjusted to set the vibrating motor 38 at a desired vibrating level in accordance with the consistency of the material being imprinted. Once the roller is aligned with the material 57 to be imprinted, the leading edge of the film roll 48 is secured to the ground along its outer edge. As the user pulls the roller 1 across the surface, the film roller 48 automatically dispenses an ultra-thin film of elastic material, such as a thin film formed of plastic. This ultra-thin material prevents direct contact between the malleable surface 57 and the roller 1. As the shell 4 comes in contact with the film 49, the ribs 56, 58 and 60 force the film 49 into the grooves 72 within the malleable surface. The ultra-thin and elastomeric characteristics of the film 49 enable it to be stretched easily and permanently. Thus, after the roller 1 passes over a particular region of the malleable surface 57, the stretched regions of the film 49 remain within the grooves 72 of the malleable surface 57. By using an ultra-thin film 49 which is easily stretched, the stretched regions of the film do not exert undue force along the edges 76 of the grooves 72. Thus, the instant invention is able to produce evenly rounded corners along the edges 76 of each block 78 within the pattern on the surface 57. Further, this stretching characteristic of the film 49 enables an increased depth of the grooves 72. The film 49 is left upon the surface 57 for a desired amount of time to provide a preferred texture along the surface 57. The longer that the film 49 is left, the slicker the finish upon the surface 57.

Turning to the present method for painting a concrete surface, initially a mixture is prepared including a stain, dye, paint and the like, (collectively referred to as stain) to which is added an adhesive and water. In the preferred example, a stain or dye is mixed with glue and water in the proportions of 2:1:1 (i.e. 2 parts stain or dye, 1 part adhesive glue and 1 part water). It is to be understood that the proportions within this combination may be varied slightly so long as the resulting combination remains consistent with the present objectives. Once the combination is mixed, it is applied to a concrete surface which is substantially cured. By way of example, to achieve optimal performance, the present mixture should not be applied to the concrete until it has cured for approximately two weeks. This curing time may vary depending upon the environmental conditions and the type and consistency of the concrete. Once it is cured sufficient to be considered "chemically dried", the present stain mixture is applied to the concrete in any known manner, such as with a conventional paint roller.

Thereafter, the initial coat is allowed to dry for approximately one hour and a second coat is applied. Next, the mixture is allowed to dry overnight, after which a third coat is applied. This third and final coat is allowed to dry again overnight, after which a water sealer is applied to the concrete.

It is to be understood that fewer or more coats may be applied as desired, so long as they remain consistent with the present invention.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. An apparatus for imprinting a pattern upon a malleable surface as said apparatus is rolled across said surface, said apparatus comprising:

a hub constructed with a cylindrically-shaped frame for rotation about a rotational axis when pulled in a direction perpendicular to said axis;

means for pulling said hub in a direction parallel to the rotational axis of the hub, thereby causing said hub to rotate; and a cylindrically-shaped pattern forming shell, detachably mounted on said hub, having a plurality of ribs secured upon an outer periphery thereof, said ribs forming said desired pattern in the malleable surface when rolled thereacross, said shell being slidably received over said hub.

2. An apparatus according to claim 1, wherein said shell includes a seam traversing a length thereof to enable said shell to expand and contract radially to engage frictionally and disengage said hub.

3. An apparatus according to claim 2, wherein said shell is slidably received over said hub in a direction parallel to said rotational axis when said seam is expanded to provide said shell with a diameter greater than that of the hub.

4. An apparatus according to claim 2, wherein said shell is frictionally secured to said hub by closing said seam to cause a diameter of said shell to equal substantially that of said hub.

5. An apparatus according to claim 1, wherein said hub includes inner and outer circular bands located on opposite ends thereof rotatably secured to opposite ends of an axle and aligned to rotate about said rotational axis, said hubs frictionally engaging said shell when mounted.

6. An apparatus according to claim 5, wherein said hub further comprises flat support straps interconnected between said inner or outer bands extending parallel to said rotational axis of the hub to engage frictionally and support said shell.

7. An apparatus according to claim 1, further comprising an axle secured to said pulling means for receiving said hub, said axle including inner and outer hub retainers secured thereto approximate and in abutting relation with collars supporting said hub in a desired position relative to the axle.

8. An apparatus according to claim 7, wherein said axle extends beyond one end collar of said hub to form a U-shaped elbow which releasably receives said pulling means.

9. An apparatus according to claim 1, wherein said pulling means include a handle extending perpendicular to the rotational axis of the hub and secured to one end of an axle which rotatably supports the hub.

10. An apparatus according to claim 1 further comprising a motor having an unbalanced load thereon and located within said hub to cause the hub and shell to vibrate during operation to enhance the pattern impressing ability of the apparatus.

11. An apparatus according to claim 1 further comprising a film dispensing apparatus located immediately in front of said hub and aligned parallel to said rotational axis of the hub, said film supporting apparatus dispensing an ultrathin elastic film at a rate equal to the movement of the shell, said film isolating said plurality of ribs and the core of the shell from the malleable surface at all times.

12. An apparatus according to claim 11, wherein the ultrathin elastic film is constructed with sufficient elasticity to expand into, and remain within, grooves formed in the malleable surface by the plurality of ribs, said elasticity being sufficient to avoid the forming of the edges of each groove while expanding.

13. An apparatus according to claim 1, wherein said plurality of ribs includes inner and outer edging ridges running along opposite sides of the core to provide grooves along opposite sides of the pattern formed in the malleable surface.

14. An apparatus according to claim 1, wherein said shell further includes upper and lower rectangular bands formed upon the interior of the shell and running along opposite sides of a seam in said shell, said upper and lower rectangular bands being located immediately adjacent said seam, such that said bands are located immediately adjacent one another when said seam is closed.

15. An apparatus according to claim 14, further comprising locking mechanisms secured to said upper and lower rectangular bands to open and close said seam.

16. An apparatus according to claim 1, further comprising locking means, located with said shell, for closing said shell to effect virtual engagement between the shell and the hub and for releasing said shell to effect removal of the shell from the hub.

17. An apparatus according to claim 1, further comprising a support structure for connecting said pulling means, rotatably, to one end of the hub, said support structure including a support shaft projecting across a face of said hub and in a direction parallel to the rotational axis of the hub, said support shaft receiving a roll of ultrathin elastic film and dispensing this film as the apparatus is rolled across a malleable surface to prevent direct contact between the shell and the malleable surface.

18. An apparatus according to claim 1, further comprising means for adjusting a difference between an outer diameter of said hub and an inner diameter of said shell between substantially equal diameters and differing diameters in which the diameter of the shell is greater than that of the hub to facilitate removal of said shell from said hub.

19. An apparatus for imprinting a pattern upon a malleable surface as said apparatus is rolled across said surface, said apparatus comprising:

a hub constructed with a cylindrically-shaped frame for rotation about a rotational axis when pulled in a direction perpendicular to said axis; and a plurality of ribs arranged in a cylindrical-shape, said ribs being slidably received over, and detachably mounted upon, said hub, said ribs forming said desired pattern in the malleable surface when rolled thereacross, said plurality of ribs including a seam traversing a length thereof to enable said ribs to expand and contract radially to engage frictionally and disengage said hub.

20. An apparatus according to claim 19, further comprising a cylindrically-shaped pattern forming shell detachably mounted on said hub and having said plurality of ribs secured upon an outer periphery thereof, said shell having said seam traversing a length thereof.

21. An apparatus according to claim 19 wherein said plurality of ribs arrange a framework which is slidably received over said hub in a direction parallel to said rotational axis when said seam is expanded to provide said framework of said plurality of ribs with a diameter greater than that of the hub.

22. An apparatus according to claim 19, wherein said plurality of ribs form a framework which is frictionally secured to said hub by closing said seam to cause a diameter of said framework of said plurality of ribs to equal substantially that of said hub.

* * * * *